US010909910B2

(12) United States Patent
Jeong et al.

(10) Patent No.: US 10,909,910 B2
(45) Date of Patent: Feb. 2, 2021

(54) DISPLAY APPARATUS AND CONTROL METHOD THEREOF

(71) Applicant: SAMSUNG ELECTRONICS CO., LTD., Suwon-si (KR)

(72) Inventors: Young-hoon Jeong, Suwon-si (KR); Doo-seop Choi, Anyang-si (KR); Young-su Moon, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/465,807

(22) PCT Filed: Nov. 16, 2017

(86) PCT No.: PCT/KR2017/013025
§ 371 (c)(1),
(2) Date: May 31, 2019

(87) PCT Pub. No.: WO2018/101655
PCT Pub. Date: Jun. 7, 2018

(65) Prior Publication Data

US 2019/0311672 A1 Oct. 10, 2019

(30) Foreign Application Priority Data

Dec. 1, 2016 (KR) ..... 10-2016-0162807

(51) Int. Cl.
*G09G 3/32* (2016.01)
*G09G 3/34* (2006.01)

(52) U.S. Cl.
CPC ..... *G09G 3/32* (2013.01); *G09G 3/34* (2013.01); *G09G 2300/0876* (2013.01)

(58) Field of Classification Search
CPC ..... G09G 3/32; G09G 3/34; G09G 2300/0876
See application file for complete search history.

(56) References Cited

U.S. PATENT DOCUMENTS

2006/0279522 A1* 12/2006 Kurihara ..... G09G 3/3413 345/102
2009/0251399 A1* 10/2009 Kim ..... G09G 3/3406 345/89

(Continued)

FOREIGN PATENT DOCUMENTS

KR 10-2010-0011247 A 2/2010
KR 10-2010-0116001 A 10/2010

(Continued)

OTHER PUBLICATIONS

International Search Report (PCT/ISA/210) dated Mar. 28, 2018 issued by the International Searching Authority in International Application No. PCT/KR2017/013025.

*Primary Examiner* — Amare Mengistu
*Assistant Examiner* — Jennifer L Zubajlo
(74) *Attorney, Agent, or Firm* — Sughrue Mion, PLLC

(57) ABSTRACT

A display apparatus and control method thereof are provided. The display apparatus including: a display configured to display an image; a backlight unit including a plurality of light sources configured to emit light to a screen of the display; an image processor configured to divide an input image into a plurality of blocks, identify target brightness for each block, and adjust a control value of each of the plurality of light sources based on priority of each of the plurality of light sources; and a driver configured to drive the plurality of light sources based on the control value. Thus, the duty for controlling the quality of light from the light source is identified considering the duty of the light source corresponding to an area of which previously identified priority is high, and thus dimming control is possible taking effects of light diffusion from adjacent neighboring light sources into account.

11 Claims, 13 Drawing Sheets

(56) References Cited

U.S. PATENT DOCUMENTS

| | | | | |
|---|---|---|---|---|
| 2010/0020005 | A1* | 1/2010 | Jung | G09G 3/3426 345/102 |
| 2011/0279485 | A1* | 11/2011 | Jang | G09G 3/342 345/690 |
| 2013/0181961 | A1* | 7/2013 | Fujinaka | G09G 3/3426 345/207 |

FOREIGN PATENT DOCUMENTS

| | | | |
|---|---|---|---|
| KR | 10-2010-0131916 | A | 12/2010 |
| KR | 10-2011-0049529 | A | 5/2011 |
| KR | 10-2011-0060268 | A | 6/2011 |
| KR | 10-2011-0125027 | A | 11/2011 |

* cited by examiner (a) IMAGE BLOCK (b) TARGET BRIGHTNESS FOR EACH BLOCK (c) IMAGE AREA OF WHICH EACH LIGHT SOURCE IS IN CHARGE (a) INPUT IMAGE (b) TARGET BRIGHTNESS FOR EACH IMAGE BLOCK (c) SCREEN AREA CORRESPONDING TO LIGHT SOURCE (a) ORIGINAL IMAGE

| | BEFORE | AFTER | DIFFERENCE | DECREASE RATE |
|---|---|---|---|---|
| MINIMUM BRIGHTNESS (Nit) | 0.131 | 0.038 | 0.093 | 71% |
| POWER CONSUMPTION (Watt) | 149 | 96 | 53 | 35% |

(b) EXPERIMENTAL RESULTS (c) Backlight Emulation (BEFORE)

(d) Backlight Emulation (AFTER)

DISPLAY APPARATUS AND CONTROL METHOD THEREOF

TECHNICAL FIELD

The disclosure relates to a display apparatus and a control method thereof, and more particularly to a display apparatus supporting local dimming and a control method thereof.

BACKGROUND ART

Local dimming is applied to a liquid crystal display apparatus, which includes a light source such as a light emitting diode (LED), and a backlight unit, so as to enhance contrast of an image and reduce power consumption.

For the local dimming, the backlight unit is divided into a plurality of areas, and the quantity of light is controlled corresponding to the divided area in response to brightness of a displayed image.

Therefore, light leakage may increase due to light diffusion from other neighboring areas while the backlight unit is controlled according to the areas. Further, a certain area may be controlled more brightly than needed, and thus a problem of increasing power consumption may arise.

DISCLOSURE

Technical Problem

Local dimming is achieved without a problem of light leakage due to light diffusion from other neighboring areas or a problem of controlling a certain area more brightly than needed.

Technical Solution

According to an embodiment of the disclosure, A display apparatus including: a display configured to display an image; a backlight unit (BLU) including a plurality of light sources configured to emit light to a screen of the display; an image processor configured to divide an input image into a plurality of blocks, identify target brightness for each block, and adjust a control value of each of the plurality of light sources based on priority of each of the plurality of light sources; and a driver configured to drive the plurality of light sources based on the control value. Thus, the duty for controlling the quality of light from the light source is identified considering the duty of the light source corresponding to an area of which previously identified priority is high, thereby adjusting the output of the light source by taking effects of light diffusion from adjacent neighboring light sources into account.

The priority of each of the plurality of light sources may be varied depending on a target brightness value of a block included in an area of which each of the plurality of light sources is in charge. Further, the target brightness may be identified based on a weighted sum of a maximum pixel value and an average pixel value in a block. Thus, the priority of the light source that is in charge of the area including the brighter block is set to have higher priority, thereby efficiently mirroring the effects from the neighboring light sources.

The image processor may adjust a control value for each of the plurality of light sources based on the priority, and then adjusts control values for each of the plurality of light sources and light sources adjacent thereto based on the priority. Thus, even the duty of the neighboring light sources is iteratively updated at a time, thereby more efficiently compensating the light diffusion caused by the mutual effects.

The image processor may adjust a control value for each of the plurality of light sources, based on a control value of a current light source, a brightness difference value of a block, which has a largest difference from target brightness with the BLU being driven by the control value of the current light source, among the blocks included in an area of which each of the plurality of light sources is in charge, and a rate of making light travel from each of the plurality of light sources to the block. Further, the image processor may adjust control values for each of the plurality of light sources and light sources adjacent thereto, based on a control value of a current light source, a brightness difference value of a block, which has a largest difference from target brightness with the BLU being driven by the control value of the current light source, among the blocks included in an area of which each of the plurality of light sources is in charge, and a rate of making light travel from each of the plurality of light sources and light sources adjacent thereto to the block. Thus, the brightness of the block, which has high target brightness and is less affected by the light diffusion, among the blocks in the area is used to thereby have high reliability of results.

The control value for each of the plurality of light sources may be adjusted once or iteratively a predetermined number of times. Further, the control values for each of the plurality of light sources and light sources adjacent thereto may be adjusted once or iteratively a predetermined number of times. Thus, the latest updated control values are used in updating the next control value, thereby more efficiently compensating the effects from neighboring light sources.

The image processor may estimate brightness according to pixels of the image based on the adjusted control value, and compensate pixel data of the image based on the estimated brightness. Thus, an image considering even light emission of the light source and more improved in quality is provided to a user.

Meanwhile, according to an embodiment of the disclosure, a method of controlling a display apparatus includes: dividing an input image into a plurality of blocks and identifying target brightness for each block; adjusting a control value of each of the plurality of light sources based on priority of each of the plurality of light sources that constitute a backlight unit (BLU); and driving the plurality of light sources to emit light to a display screen based on the control value. Thus, the duty for controlling the quality of light from the light source is identified considering the duty of the light source corresponding to an area of which previously identified priority is high, thereby adjusting the output of the light source by taking effects of light diffusion from adjacent neighboring light sources into account.

The priority of each of the plurality of light sources may be varied depending on a target brightness value of a block included in an area of which each of the plurality of light sources is in charge. Further, the target brightness may be identified based on a weighted sum of a maximum pixel value and an average pixel value in a block. Thus, the priority of the light source that is in charge of the area including the brighter block is set to have higher priority, thereby efficiently mirroring the effects from the neighboring light sources.

The method may further include adjusting a control value for each of the plurality of light sources based on the priority, and then adjusting control values for each of the plurality of light sources and light sources adjacent thereto based on the priority. Thus, even the duty of the neighboring light sources is iteratively updated at a time, thereby more efficiently compensating the light diffusion caused by the mutual effects.

The adjusting of the control value for each of the plurality of light sources may include adjusting a control value for each of the plurality of light sources, based on a control value of a current light source, a brightness difference value of a block, which has a largest difference from target brightness with the BLU being driven by the control value of the current light source, among the blocks included in an area of which each of the plurality of light sources is in charge, and a rate of making light travel from each of the plurality of light sources to the block. Further, the adjusting of the control values for each of the plurality of light sources and light sources adjacent thereto may include adjusting control values for each of the plurality of light sources and light sources adjacent thereto, based on a control value of a current light source, a brightness difference value of a block, which has a largest difference from target brightness with the BLU being driven by the control value of the current light source, among the blocks included in an area of which each of the plurality of light sources is in charge, and a rate of making light travel from each of the plurality of light sources and light sources adjacent thereto to the block. Thus, the brightness of the block, which has high target brightness and is less affected by the light diffusion, among the blocks in the area is used to thereby have high reliability of results.

The control value for each of the plurality of light sources may be adjusted once or iteratively a predetermined number of times. Further, the control values for each of the plurality of light sources and light sources adjacent thereto may be adjusted once or iteratively a predetermined number of times. Thus, the latest updated control values are used in updating the next control value, thereby more efficiently compensating the effects from neighboring light sources.

The method may further include: estimating brightness according to pixels of the image based on the adjusted control value; and compensating pixel data of the image based on the estimated brightness. Thus, an image considering even light emission of the light source and more improved in quality is provided to a user.

Advantageous Effects

According to an embodiment of the disclosure, the display apparatus generates the dimming control signal by considering effects of light diffusion from the light source of the adjacent neighboring area to perform the local dimming for improving the contrast of the screen, thereby having an effect on decreasing light leakage. Further, the duty for decreasing the light diffusion is not increased more than needed, thereby reducing power consumption in the BLU.

In the display apparatus according to another embodiment of the disclosure, the area/light source-based duty-identification according to the priority and the group-based duty-identification including even the adjacent area/light source are performed in sequence to adjust the duty, and the area/light source-based duty-identification and the group-based duty-identification may be iteratively performed a predetermined number of times according to the priority. Therefore, the dimming is effectively achieved while very efficiently avoiding effects of the light diffusion from the neighboring light sources.

Further, in the display apparatus according to still another embodiment of the disclosure, the brightness of the area is estimated based on the adjusted duty to thereby compensate the pixel data of the image, thereby providing an image of more improved quality to a user.

The foregoing display apparatus according to the embodiments of the disclosure is an edge-type LCD apparatus, and more improved effects are expected when the number of light sources in the BLU is smaller than the resolution of the display.

REFERENCE NUMERALS

Figure 1:
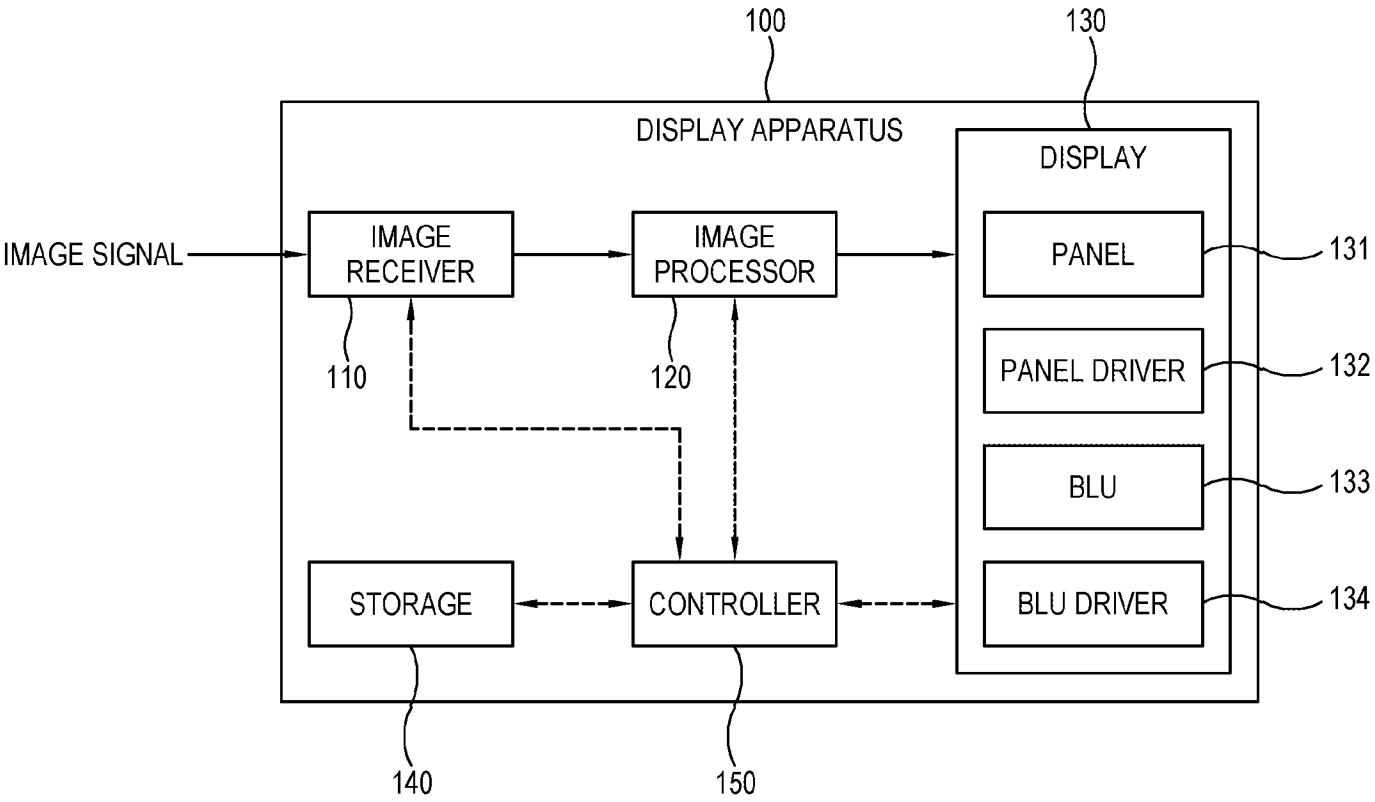
FIG. 1 is a block diagram of a display apparatus according to an embodiment of the disclosure.

100: display apparatus 110: image receiver
120: image processor
121: target brightness identifier
122: priority identifier
123: first duty identifier
124: second duty identifier
125: light quantity estimator
126: pixel compensator 130: display
131: panel 132: panel driver
133: backlight unit
134: backlight unit driver
140: storage 150: controller

BEST MODE

Below, exemplary embodiments will be described with reference to accompanying drawings to such an extent as to be easily realized by a person having an ordinary knowledge in the art. The present inventive concept is not limited to the embodiments set forth herein, and may be actualized variously. For clarity of the disclosure in association with the drawings, portions not directly related to the elements of the disclosure may be omitted, and like numerals refer to like elements throughout. In the following descriptions, terms such as "include" or "have" refer to presence of features, numbers, steps, operations, elements or combination thereof, and do not exclude presence or addition of one or more other features, numbers, steps, operations, elements or combination thereof.

FIG. 1 is a block diagram of a display apparatus 100 according to an embodiment of the disclosure.

As shown in FIG. 1, the display apparatus 100 displays an image based on an image signal provided from an external image source (not shown) and processed according to a preset image processing process.

According to an embodiment, the display apparatus 100 may be achieved by a TV that processes a broadcast image based on a broadcast signal/broadcast information/broadcast data received from a transmitter of a broadcasting station.

However, the concept of the disclosure is not limited to this embodiment of the display apparatus 100. The display apparatus 100 may be achieved by not only the TV but also various embodiments capable of processing an image, for example, a monitor connected to a computer, a smart phone or a smart pad such as a tablet computer, a personal digital assistant, a smart watch, or the like various apparatuses with the BLU. Further, the display apparatus 100 of the disclosure may be applied to a large-sized display apparatus. For example, the display apparatus 100 according to an embodiment of the disclosure may include a digital Signage, a large format display (LFD), a video wall using a plurality of display apparatuses, etc.

Further, the kind of image signal processed by the display apparatus 100 is not limited to a satellite broadcast signal. The display apparatus 100 may receive an image signal from various external apparatuses. Further, the display apparatus 100 such as the TV may process a signal to display thereon a moving image, a still image, an application, an on-screen display (OSD), a user interface (UI or hereinafter also referred to as a graphic user interface (GUI)), or the like based on a signal/data stored in an internal/external storage medium.

Meanwhile, the broadcast signal received in the display apparatus 100 may be transmitted through a terrestrial wave, a cable, etc., and the signal source of the disclosure is not limited to the broadcasting station. That is, the signal source of the disclosure may include an apparatus or a station as long as it can transmit and receive information.

According to an embodiment, the display apparatus 100 may be actualized by a smart TV or Internet protocol (IP) TV. The smart TV may receive and display a broadcast signal in real time, support a web browsing function to search and consume various pieces of content through the Internet while displaying a broadcast signal in real time, and thus provide a convenient user environment for the web browsing function. Further, the smart TV includes an open software platform, and thus provides an interactive service to a user. Therefore, the smart TV can provide various pieces of content, for example, an application for offering a predetermined service to a user through the open software platform. Such an application refers to an application program capable of providing various kinds of service, and may for example include applications for providing social network service (SNS), finance, news, weather, map, music, movie, game, electronic book, and the like service.

That is, the embodiments set forth herein merely refer to examples varied depending on systems, and thus are not construed as limiting the concept of the disclosure.

Below, details of the display apparatus 100 according to an embodiment of the disclosure will be described with reference to the accompanying drawings.

As shown in FIG. 1, the display apparatus 100 includes an image receiver 110 configured to receive an image signal, an image processor 120 configured to process the image signal received in the image receiver 110, a display 130 configured to display an image based on the image signal processed by the image processor 120, a storage 140 configured to store various pieces of data/information, and a controller 150 configured to control operation of the general elements of the display apparatus 100.

The image receiver 110 receives and transmits an image signal to the image processor 120, and may be variously actualized according to the formats of the received image signal and the types of the display apparatus 100. For example, the image receiver 110 may receive a radio frequency (RF) signal from a broadcasting station (not shown) wirelessly, or may receive an image signal based on composite video, component video, super video, syndicat des constructeurs d'appareils radiorécepteurs et téléviseurs (SCART), high definition multimedia interface (HDMI), standards, etc. through a wire.

According to an embodiment, the image receiver 110 includes a tuner to be tuned to a channel for a broadcast signal when the image signal is the broadcast signal. The tuner (also referred to as a tuner module or a tuner circuitry) may include an RF tuner and a demodulator.

Further, the image signal may be received from an external device, for example, a smart phone, a smart pad such as a tablet computer, a mobile device including a MP3 player, a personal computer (PC) such as a desktop or laptop computer.

Further, the image signal may be caused by data received through the Internet or the like network. In this case, the display apparatus 100 may further include a communicator (not shown) that performs communication through the network.

Further, the image signal may be caused by data stored in a flash memory, a hard disk drive, or the like nonvolatile storage 140. The storage 140 may be provided inside or outside the display apparatus 100. When the storage 140 is placed outside the display apparatus 100, a connector (not shown) to which the storage 140 is connected may be additionally needed.

The image processor 120 performs various preset video/audio processes with regard to an image signal received from the image receiver 110. The image processor 120 outputs an output signal generated or combined by performing such a video processing process to the display 130, so that an image corresponding to the image signal can be displayed on the display 130.

The image processor 120 includes a decoder configured to decode the image signal according to the video formats of the display apparatus 100, and a scaler configured to adjust the image signal according to output standards of the display 130. The decoder in this embodiment may for example be actualized by a moving picture experts group (MPEG) decoder.

Here, there are no limits to the kind of image processing processes to be performed by the image processor 120 according to the disclosure. For example, the image processor 120 may perform at least one among various processes such as de-interlacing for converting a broadcast signal from an interlaced type into a progressive type, noise reduction for improving image quality, detail enhancement, frame refresh rate conversion, line scanning, etc.

According to an embodiment, the image processor 120 divides an input image according to a plurality of blocks (virtual blocks), identifies target brightness for each block, and identifies, i.e. adjusts each control value of a plurality of light sources that constitute a backlight unit (BLU) 133 of the display 130 (to be described later) according to predetermined priority. Here, each priority of the plurality of light sources may vary depending on target brightness of a block included in a display screen area, of which each of the plurality of light sources takes charge.

According to an embodiment, the screen of the display 130, on which an image is displayed, includes a plurality of areas corresponding to the plurality of light sources that constitute the BLU 133, and the plurality of areas may include a plurality of blocks arranged in a progress direction of light output from the corresponding light sources. The plurality of light sources are respectively in charge of the plurality of areas, and light is transmitted to the screen of the display 130 in accordance with operation of the corresponding light source.

The image processor 120 identifies each priority of the plurality of light sources based on pixel data about the plurality of blocks of the input image, and calculates a control value, i.e. a duty value for controlling the quantity of light from the light source in order of priority. The calculated duty value is used by a BLU driver 134 in local dimming for controlling the quantity of light according to the light sources.

According to an embodiment, a control value of a predetermined target light source is adjusted with reference to a previously calculated control value of at least one light source that has a higher priority than the target light source.

Further, the image processor 120 may further perform compensation with regard to pixel data of an input image with the adjusted control value.

The image processor 120 may be actualized by individual groups capable of independently performing such processes, or a system-on-chip into which many functions are integrated.

According to an embodiment, the image processor 120 may be actualized as included in a main SoC mounted on a printed circuit board (PCB) provided inside the display apparatus 100, and the main SoC may include at least one processor as an example of the controller 150 (to be described later).

According to an embodiment, the image processor 120 may be actualized by an image board in which various chipsets, a memory, an electronic part, wiring, and the like circuit elements for performing such processes are mounted on the PCB. In this case, the display apparatus 100 may include the image receiver 110, the image processor 120 and the controller 150 which are provided on a single image board. Of course, this case is merely an example, and the image receiver 110, the image processor 120 and the controller 150 may be arranged on a plurality of PCBs connected communicating with each other. The image board may be accommodated in a casing.

According to an embodiment, the display apparatus 100 may include a PCB to which a tuner chip corresponding to the tuner and a main SoC are mounted.

The broadcast signal processed by the image processor 120 is output to the display 130. The display 130 displays an image based on an image signal received from the image processor 120.

According to an embodiment of the disclosure, the display 130 may be actualized by a liquid crystal method.

The display 130 may additionally include an appended element in accordance with actualization methods.

Figure 2:
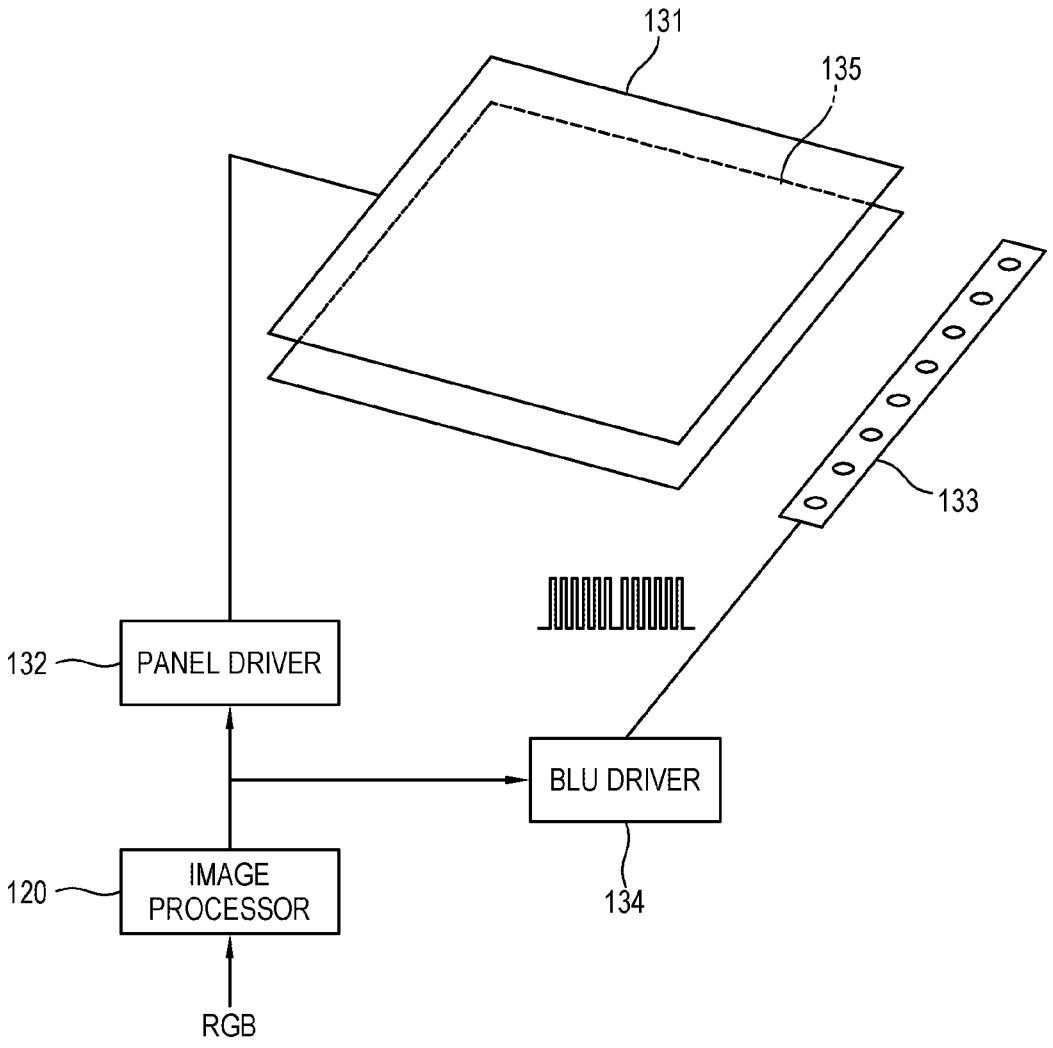
FIG. 2 is a view schematically illustrating a display according to an embodiment of the disclosure.

FIG. 2 is a view schematically illustrating a display 130 according to an embodiment of the disclosure.

The display 130 according to an embodiment of the disclosure may, as shown in FIGS. 1 and 2, include a panel 131 displaying an image thereon, a panel driver 132 driving the panel 131, the BLU 133 provided as a light source for illuminating the panel 131, and the BLU driver 134 driving the BLU 133. On the back of the panel 131, a light guide plate 135 may be disposed to make incident light from the BLU 133 be diffused and travel frontward.

The BLU 133 is classified into an edge type where the light source is disposed in at least one edge of the panel 131 of the display 130, and a direct type where the light source is disposed on the back of the panel 131.

According to an embodiment, the BLU 133 may include a light emitting diode (LED) as a plurality of light sources.

According to an embodiment of the disclosure, the BLU 133 may be actualized by an edge type BLU where the light sources are arranged at the edge of the panel 131, i.e. on a display screen in at least one direction.

Figure 3:
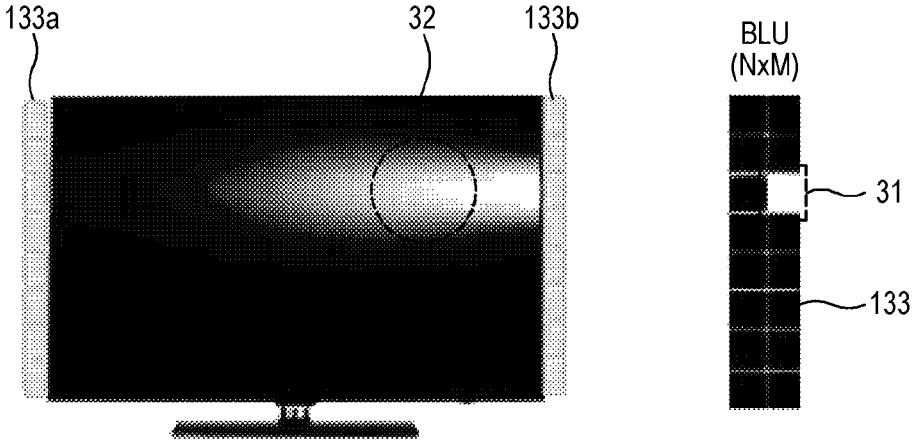
FIG. 3 is a view illustrating a backlight unit (BLU) arranged according to an embodiment of the disclosure.
Figure 4:
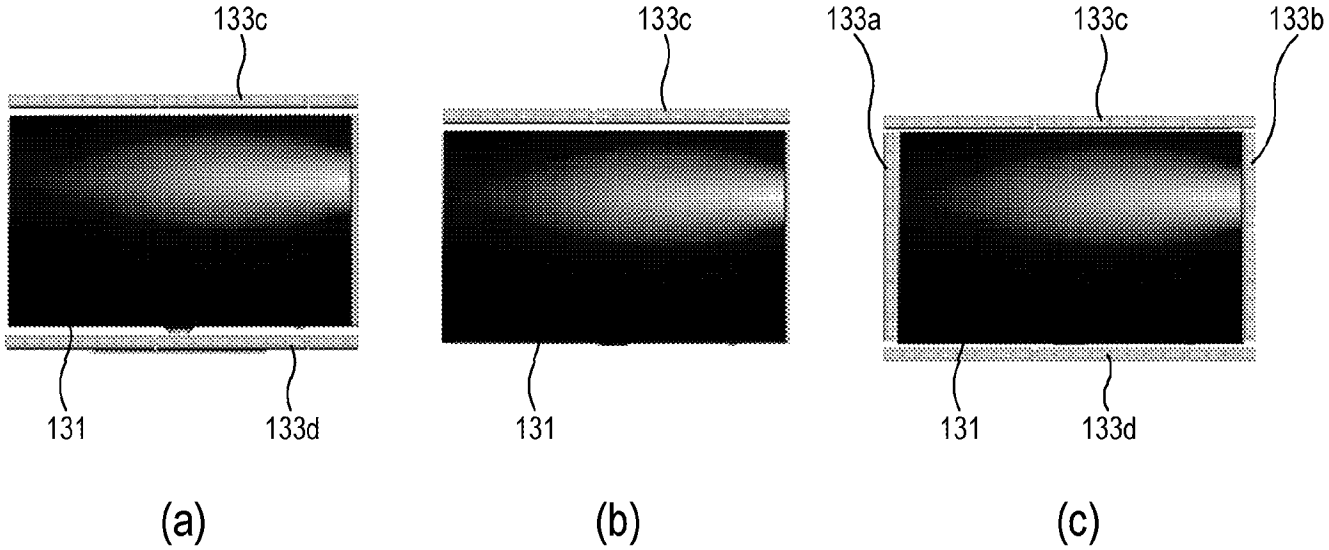
FIG. 4 is a view illustrating a BLU arranged according to other embodiments of the disclosure.

FIG. 3 is a view illustrating the BLU 133 arranged according to an embodiment of the disclosure, and FIG. 4 is a view illustrating a BLU arranged according to other embodiments of the disclosure.

As shown in FIG. 3, the BLU 133 includes LED bars 133*a* and 133*b* respectively arranged in two rows along the left and right sides of the panel 131 and including N by M light sources as an individual unit. Each light source emits light to a corresponding area of the screen. For example, as shown in FIG. 3, a predetermined screen area 32 becomes brighter with light emitted from a corresponding light source 31.

According to other embodiments, the BLU 133 may be arranged along the top and bottom edges 133*c* and 133*d* of the panel 131 as shown in (a) of FIG. 4, or may be arranged along one 133*c* of the top and bottom edges as shown in (b) of FIG. 4. Further, the BLU 133 may be arranged along the top, bottom, left and right, i.e. four edges 133*a*, 133*b*, 133*c* and 133*d* as shown in (c) of FIG. 4.

That is, the BLU 133 according to the disclosure is arranged along at least one direction of the display screen, i.e. the panel 131, and it will be appreciated by a person having an ordinary skill in the art that the arranging directions or positions or the number of edges for the arrangement, etc. may be varied, added or deleted according to performance of the display apparatus 100.

In the display apparatus 100 according to the disclosure, the area of the screen corresponding to each light source may be set in accordance with the array pattern of the BLU 133. For example, the screen is set to have 2×8 areas corresponding to the BLU 133 having a pattern of 2×8 as shown in FIG. 2.

The BLU driver 134 drives the BLU 133 to emit light toward the panel 131.

According to an embodiment, the BLU driver 134 may drive each of the plurality of light sources based on the control value i.e. the duty value from the image processor 120.

According to this embodiment of the disclosure, duty of an electric current, i.e. a light source control signal output from the BLU driver 134 may be controlled to make a predetermined light source of the BLU 133 emit desired quantity of light.

Therefore, the display 130 can perform dimming, in which the quantity of light is controlled according to the light sources of the BLU 133.

Referring back to FIG. 1, the storage 140 is configured to store data without limitations under control of the controller 150. The storage 140 may include a nonvolatile memory, a volatile memory, a flash memory, a hard disk drive (HDD), or a solid-state drive (SSD). The storage 140 may be accessed by the controller 150 and perform reading/recording/modifying/deleting/updating, etc. based on the controller 150.

The data stored in the storage 140 may for example include an operating system for operating the display apparatus 100, various applications executable on the operating system, appended data, etc.

Specifically, the storage 140 may be configured to store input/output signal or data corresponding to operation of elements 110, 120, 130 under control of the controller 150. The storage 140 may be configured to store a GUI related to an application downloaded from the outside or provided by a manufacturer and a control program for controlling the display apparatus 100, images for providing the GUI, user information, documents, databases, or pieces of related data.

According to an embodiment of the disclosure, a term 'storage' is defined to include the storage 140, a read only memory (ROM, not shown), a random-access memory (RAM, not shown), or a memory card (e.g. a micro secured digital (SD) card, and a memory stick, not shown) mountable to the display apparatus 100.

The controller 150 performs control with regard to various elements of the display apparatus 100. Specifically, the controller 150 controls general operation of the display apparatus 100 and signal flow between the elements of the display apparatus 100, and performs a function of processing data. For example, the controller 150 performs an image processing process of the image processor 120, and performs operation to cope with a command from a user input (not shown) such as a remote controller, thereby controlling the whole operation of the display apparatus 100.

When there is a user's input or when a preset and stored condition is satisfied, the controller 150 may execute an operating system (OS) and various applications stored in the storage 140.

According to an embodiment, the controller 150 may include at least one processor, a nonvolatile memory, i.e. ROM configured to store a control program for controlling the display apparatus 100, and a volatile memory, i.e. RAM configured to store a signal or data received from the outside of the display apparatus 100 or used as a storage area for various jobs implemented in the display apparatus 100. The processor loads a program from the ROM storing the program to the RAM and executes the program.

The controller 150 according to this exemplary embodiment is actualized by a central processing unit (CPU), an application processor (AP), a microcomputer (MICOM) and at least one universal processor, and for example controls a program corresponding to a predetermined algorithm stored in the ROM to be loaded to the RAM and executed, thereby performing various operations of the display apparatus 100.

When the controller 150 of the display apparatus 100 is actualized by a single processor, e.g. a CPU, the CPU may be provided to carry out various functions to implemented in the display apparatus 100, for example, control of various image processing processes with regard to an image displayed on the display 130, operation to cope with a user's command from the user input (not shown), control of wired/wireless network communication with an external apparatus through the communicator, etc.

The processor may include a single core, a dual core, a triple core, a quad core, and the like multiple core. The processor may include a plurality of the processor, for example, a main processor, and a sub processor operating in a sleep mode (for example, no operations for the display apparatus with only standby power. Further, the processor, the ROM and the RAM may connect with one another through a system bus.

When the display apparatus 100 according to an embodiment of the disclosure is actualized as a monitor, the controller 150 may further include a graphic user interface (GUI, not shown) for graphic processing.

Further, the display apparatus 100 according to another embodiment of the disclosure is actualized as a digital TV, a smart phone, a smart pad, etc. the processor may include the GPU. For example, the processor may be achieved in the form of an SoC where the core and the GPU are coupled.

As an example of the controller 150 in the disclosure, the processor may be actualized as included in a main SoC mounted to a built-in PCB of the display apparatus 100. Alternatively, the main SoC may further include the image processor 120 for processing an image signal.

The display apparatus 100 according to the foregoing embodiment of the disclosure performs local dimming of the BLU 133 by controlling duty of a dimming control signal provided to each light source of the BLU 133.

Figure 5:
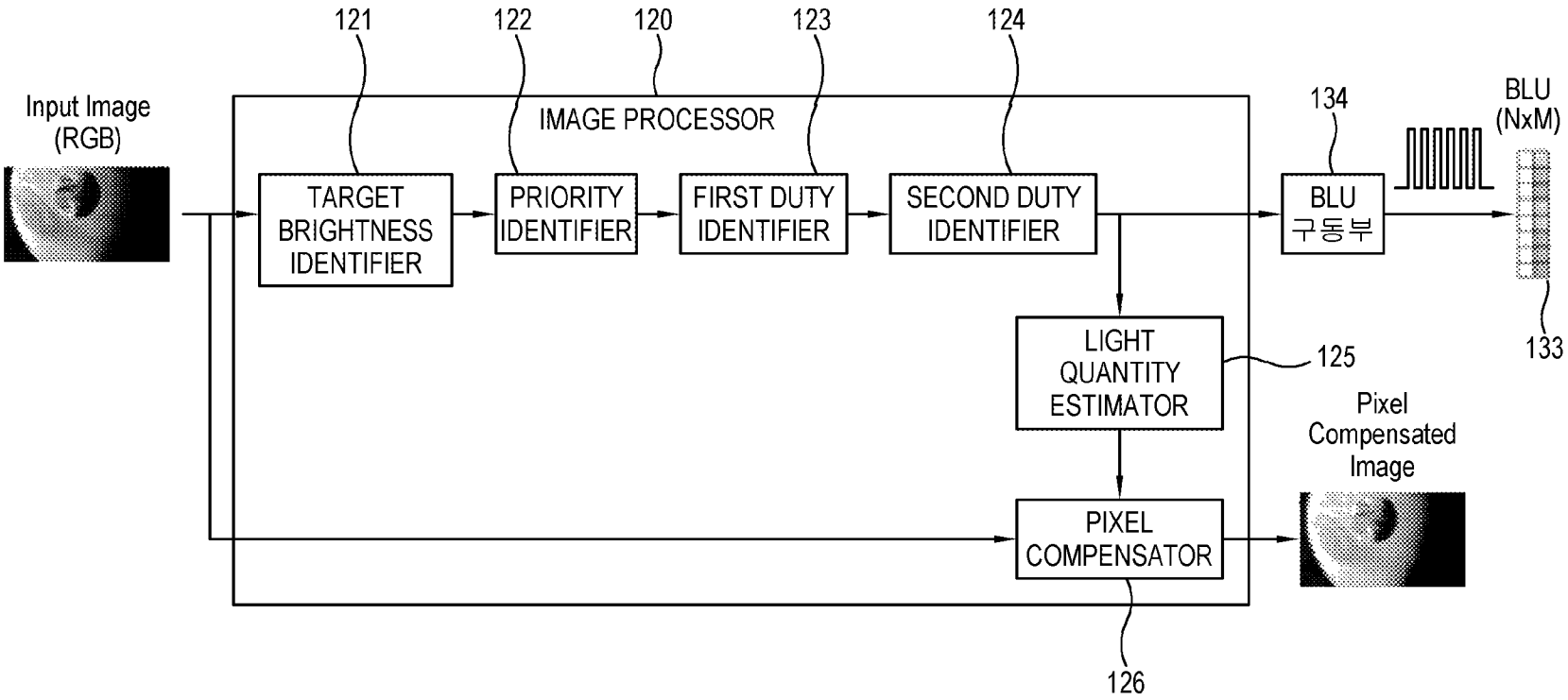
FIG. 5 is a block diagram of an image processor of a display apparatus according to an embodiment of the disclosure the display apparatus.

FIG. 5 is a block diagram of the image processor 120 of the display apparatus 100 according to an embodiment of the disclosure the display apparatus.

As shown in FIG. 5, the image processor 120 may include a target brightness identifier 121, a priority identifier 122, a first duty identifier 123, a second duty identifier 124, a light quantity estimator 125, and a pixel compensator 126.

Figure 6:
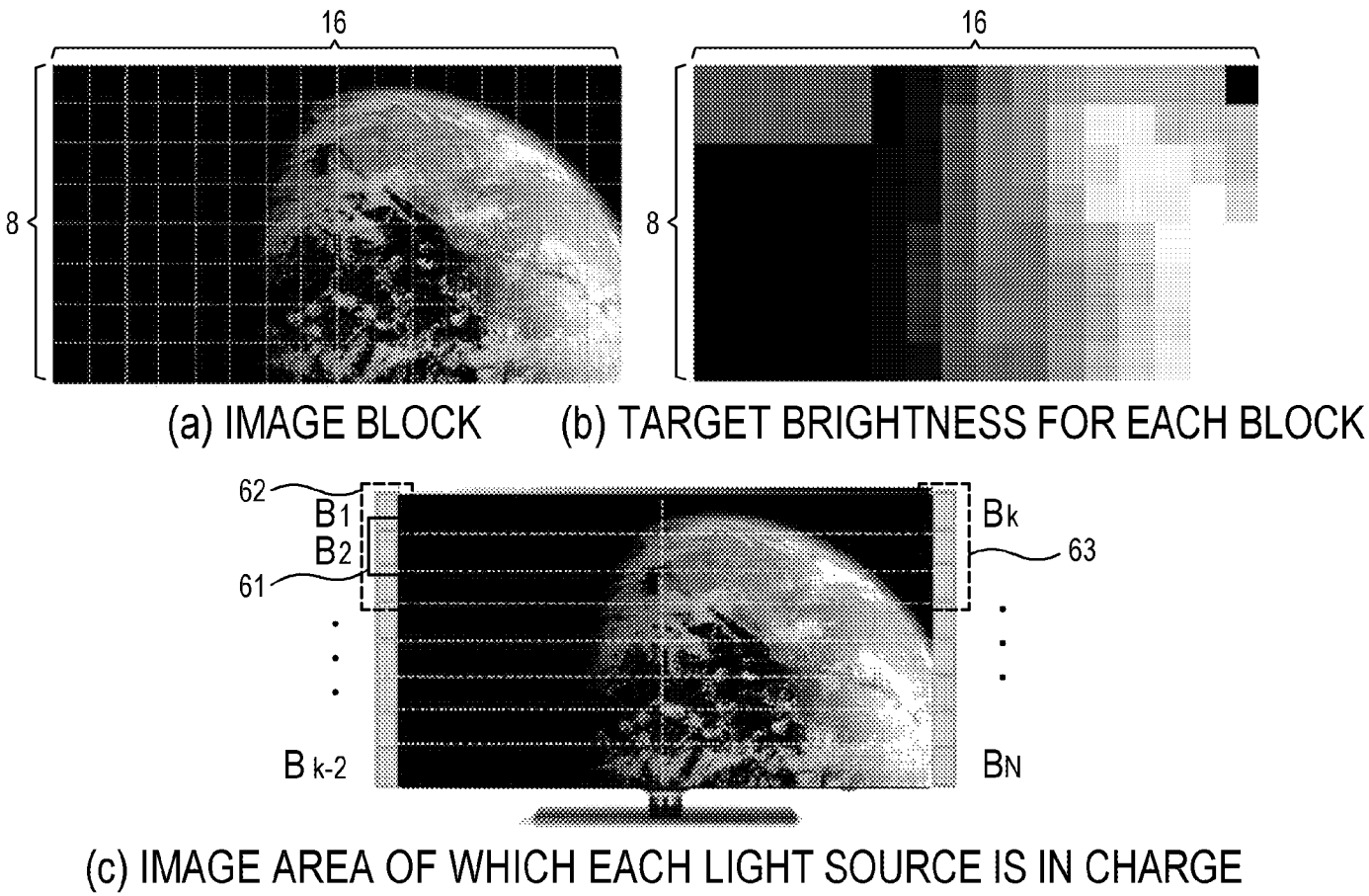
FIG. 6 is a view for describing a process of dividing an image into a plurality of blocks and setting a screen area corresponding to each block according to an embodiment of the disclosure.

FIG. 6 is a view for describing a process of dividing an image into a plurality of blocks and setting a screen area corresponding to each block according to an embodiment of the disclosure.

The target brightness identifier 121 divides an input image into a plurality of virtual blocks, and identifies target brightness corresponding to each block based on pixel data of pixels included in the divided block. Here, the target brightness identifier 121 divides an image corresponding to one frame into a plurality of blocks.

The target brightness identifier 121 may be set to divide an image based on an image signal into N by W virtual blocks, for example, 16×8 blocks as shown in (a) of FIG. 6. Here, the number of set blocks may be varied depending on the size of the image.

The target brightness identifier 121 may identify backlight target brightness (below, referred to as an intermediate target value or a first target value) corresponding to each divided block, based on a pixel value showing pixel data, e.g. brightness included in each block of an input image signal.

According to an embodiment, the target brightness i.e. the first target value of the block may be calculated, i.e. identified based on a weighted sum of the maximum pixel value and an average pixel value among pixel values in the corresponding block. In the disclosure, the first target value may be actualized by various mathematical calculations using the pixel data showing the brightness of the image. However, there are no needs of indispensably using the maximum pixel value and the average pixel value or obtaining the weighted sum of the maximum pixel value and the average pixel value.

(b) of FIG. 6 illustrates an example in which the target brightness is identified corresponding to each block.

The priority identifier 122 identifies the backlight target brightness (hereinafter, referred to as a final target value or a second target value) according to a plurality of areas set in the display screen corresponding to the plurality of light sources of the BLU 133 by using the calculated target brightness (a first target value) corresponding to the block, and identifies priority for adjusting each control value of the plurality of light sources corresponding to the areas according to the identified results.

In the display apparatus 100 including the BLU 133 with N by W light sources as shown in FIG. 3, the display screen is also divided into N by W areas as shown in (c) of FIG. 6.

In the display apparatus 100 according to an embodiment of the disclosure, each divided screen area may include two or more image blocks (for example, one screen area may include eight image blocks continued in a widthwise direction as shown in FIG. 6).

According to an embodiment, the target brightness of the area, i.e. the second target value (or the final target value) may be calculated, i.e. identified by the weighted sum of the maximum value and the average value among the first target values (or the intermediate target values) identified with respect to the block in the corresponding area. In the disclosure, the second target value may be identified by various mathematical calculations using the first target value according to the image blocks. However, there are no needs of indispensably using the maximum pixel value and the average pixel value or obtaining the weighted sum of the maximum pixel value and the average pixel value.

Further, the priority identifier 122 identifies the priority according to the plurality of areas to correspond to the target brightness (or the second target value) according to the calculated screen areas. Here, the priority of the area is regarded as the priority of the corresponding light source.

According to an embodiment, the plurality of screen areas has higher priority as the calculated second target value becomes greater, i.e. as the image displayed on the corresponding screen area becomes brighter.

The first duty identifier 123 calculates a control value (first duty) to adjust an optical output from the light sources in sequence starting from the light source having the higher priority, identified by priority identifier 122, with respect to the plurality of light sources that constitute the BLU 133.

The first duty is sequentially calculated starting from the light source having the higher priority among the plurality of light sources, each of which is provided as an individual unit of the BLU 133, matching each of N by M screen areas as shown in (c) of FIG. 6. Here, the duty value of the $k^{th}$ light source may be calculated based on the previously calculated duty value of at least one light source having higher priority than the $k^{th}$ light source.

In other words, the control value (i.e. the duty value) of the light source (i.e. the first light source) expected to have the highest brightness is first identified, and then has an effect on identifying the control value (i.e. the duty value) of the light source (i.e. the second light source) expected to have the next highest brightness.

Therefore, the duty of the first light source is used in identifying the duty of the second light source and the like light sources having lower priority, and thus repetitively used in identifying the duty of the light sources according to priority, thereby having considering light leakage from other areas (i.e. relatively bright areas) while identifying the duty according to the light sources.

According to an embodiment, the first duty identifier 123 may calculate the first duty once according to the priority with respect to each of the plurality of light sources (i.e. each area corresponding to the light source).

Alternatively, the first duty identifier 123 may iteratively calculate the first duty a predetermined number of times (e.g. ten times) according to the priority with respect to each of the plurality of light sources (i.e. each area corresponding to the light source). Here, the calculation of the first duty in a second cycle or after the second cycle is performed in such a manner that the first duty of each light source calculated in the previous cycle is updated.

In the foregoing embodiments, the control value (i.e. the first duty) of each light source/area may be calculated based on the following expressions.

$$B_k' = B_k + c \cdot \Delta_k \quad \text{[Expression 1]}$$

where, $B_k$ is the current duty value of the $k^{th}$ light source, and $B'_k$ is the duty value calculated based on the $k^{th}$ light source. Therefore, $B_k$ in the first cycle may be set to have a predetermined default, for example, 0.

c is identified corresponding to the number of times for calculating the first duty. For example, c is 1 when the calculation is performed once, and 0.1 when the calculation is performed ten times.

$\Delta_k$ is an adjustment value (or changed value) of the first duty with respect to a predetermined light source, and is obtained by the following expression 2.

$$\Delta_k = \frac{T_i - \left(\sum_m L_m^i \cdot B_m\right)}{L_k^i} \quad \text{[Expression 2]}$$

where, $L^i_k$ is defined as a light spread coefficient (LSC), i.e. a rate of making light travel to a position of the $i^{th}$ block on an image when the $k^{th}$ light source emits light, and has a value between 0 and 1. For example, the LSC of the block closest to the $k^{th}$ light source approximates to 1, but the LSC of the block farthest from the $k^{th}$ light source approximates to 0. Therefore, $\Sigma_m L_m{}^i \cdot B_m$ is the quantity of light propagated to the $i^{th}$ block on the image on the assumption that all the light sources emit light with the duty value identified with respect to the current light source.

$T_i$ is the target brightness (i.e. the first target value/the intermediate target value) of the $i^{th}$ block. The first target value is calculated by the foregoing target brightness identifier 121.

Therefore, $\Delta_k$ of the $k^{th}$ light source in the expression 2 is obtained based on the target brightness (i.e. the first target value/the intermediate target value) of a predetermined block among the image blocks within the screen area ($R_k$) corresponding to the light source (k), and the index i of the corresponding block is calculated by the following expression 3.

$$i = \underset{blk_idx \in R_k}{\operatorname{argmax}} \left\{ T_{blk_idx} - \left(\sum_m L_m^{blk_idx} \cdot B_m\right) \right\} \quad \text{[Expression 3]}$$

By the expression 3, the block index i indicates a block, which the highest value of $T_i - (\Sigma_m L_m{}^i \cdot B_m)$, among the blocks included in the area ($R_k$) of which the $k_{th}$ light source is in charge, and is identified as the index of the block, of which difference between the target brightness (i.e. the first target value/the intermediate target value) and the quantity of light emitted from the light source to the corresponding block is the greatest, when the BLU 133 is driven with the control value of the current light source. Here, the quantity of light corresponding to the block is the quantity of light propagated to a predetermined block in a case where all the light sources emit light when the BLU 133 is driven with the current control value (i.e. the duty value).

According to the embodiments of the disclosure based on the expressions 1 to 3, the image processor 120 identifies each control value $B'_k$ of the plurality of light sources based on the control value $B_k$ of the current light source, the largest brightness difference $T_i-(\Sigma_m L_m^i \cdot B_m)$ between the block (i.e. the $i^{th}$ block) and the target brightness when the BLU 133 is driven with the control value of the current light source among the blocks included in the areas of which the plurality of light sources is in charge, and a rate $L^i_k$ by which light travels from each of the plurality of light sources to the block (i.e. the $i^{th}$ block).

When the duty of the $k^{th}$ light source is identified by the foregoing processes, the duty of the $j^{th}$ light source is identified as the light source having the next highest priority. Here, $\Delta_j$ of the $j^{th}$ light source is calculated by applying the duty, which is identified with regard to all the light sources having higher priority than the $j^{th}$ light source as well as the $k^{th}$ light source, to the expression 2.

Further, the block index i in the expression 2 is the index of the block, which has the largest $T_i-(\Sigma_m L_m^i \cdot B_m)$, among the blocks within the areas $R_j$ of which the $j^{th}$ light source is in charge.

In result, the first duty identifier 123 identifies an adjustment value based on the target brightness (i.e. the first target value/the intermediate target value) of a predetermined block (i.e. the $i^{th}$ block), and the rate (LSC) of making light travel to the corresponding block (i.e. the $i^{th}$ block) among the image blocks included in the screen area of which the corresponding light source takes charge according to light emission of a predetermined light source $B_k$, and calculates the control value (i.e. the first duty) of the light source corresponding to the area $R_k$ including the corresponding block using the identified adjustment value. Here, the first duty identifier 123 identifies the duty as the control value to adjust the optical output of the light source corresponding to the screen area including the block, based on the adjustment value identified with regard to the block, which has the largest difference between the quantity of light emitted from the light sources in the BLU 133 to the block and the target brightness (the first target value/the intermediate target value), among the blocks included in the area corresponding to a predetermined light source $B_k$.

The first duty identifier 123 iteratively performs calculation of the control value (i.e. the first duty) for each of the plurality of light sources a predetermined number of times (e.g. ten times) according to the priority, and makes the first duty of a predetermined light source be continuously updated in consideration of the effect of the current duty value on other light sources, thereby continuously adjusting duty of a dimming control signal applied to each light source.

The second duty identifier 124 updates the first duty of each light source, identified by the first duty identifier 123, according to light source groups including a predetermined light source and at least one light source adjacent to the corresponding light source. Here, each of the plurality of areas on the screen corresponds to each of the plurality of light sources, and therefore the second duty identifier 124 makes the control value identified for each of the plurality of areas be updated in units of a group including a predetermined area and its adjacent area.

Specifically, the second duty identifier 124 calculates control values (i.e. second duty) to adjust the optical output from the light source in sequence for the plurality of light sources included in a group including a light source having higher priority identified by the priority identifier 122 and adjacent light sources, with respect to the plurality of light sources that constitute the BLU 133.

The second duty is calculated in sequence from the group including the light source having the higher priority with regard to the light sources included in the group, which includes a light source and its adjacent light sources as individual units of the BLU 133 matching N by M screen areas, as shown in (c) of FIG. 6.

The number of adjacent light sources included in the group is set according to an array pattern of the BLU 133, the number of included light sources, etc. For example, as shown in (c) of FIG. 6, one group including a plurality of light sources B1, B2, B3, Bk, Bk+1, Bk+2, 62, 63 may be set with regard to the light source B2 61.

Here, the duty value for the group of the $k^{th}$ light source is updated again using the duty value previously updated with regard to the group of at least one light source having higher priority than the corresponding light source.

In other words, the duty value of the group (i.e. the first group) of the light source (i.e. the first light source) expected to have the highest brightness is first updated, and then the updated duty value of the group of the first light source has an effect on updating the duty value of the light source within the group of the light source (i.e. the second light source) expected to have the next highest brightness.

Therefore, the updated duty values of the light sources in the first group are used in updating the duty value of the light sources in a low priority group including the light sources of the second group, and iteratively used in updating the duty value of the light sources in the groups according to the priority, thereby iteratively updating the light sources in the groups while taking the latest updated duty values. Accordingly, even the effect of the light leakage from other light sources is taken into account, thereby expecting an effect on reaching an optimum duty value according to the light sources.

According to an embodiment, the second duty identifier 124 may perform calculation of the second duty for the group including the plurality of light sources (i.e. the plurality of light sources and their adjacent light sources) once according to the priority.

Alternatively, the second duty identifier 124 may repetitively perform calculation of the second duty for the group including the plurality of light sources (i.e. the plurality of light sources and light sources adjacent thereto) a predetermined number of times (e.g. ten times) according to the priority. Here, the calculation of the second duty in a second cycle or after the second cycle is performed in such a manner that each second duty calculated in the previous cycle is updated.

In the foregoing embodiments, the second duty of each group may be calculated based on the following expressions.

$$B_k'=B_k+c\cdot\Delta_k, k\in N_k \quad \text{[Expression 4]}$$

where, $N_k$ is defined as a set of elements, i.e. indexes of the $k^{th}$ light source and its neighboring (adjacent) light sources. Therefore, based on the expression 4, while the duty value of the $k^{th}$ light source is updated, the duty values of other light sources in the group adjacent to the corresponding light source are also updated.

$B_k$ is the current duty values of the light sources included in the $k^{th}$ group, and $B'_k$ is the duty value calculated based on the $k^{th}$ light source. Therefore, $B_k$ in the first cycle may be set as a set of values calculated by the first duty identifier 123.

c is identified corresponding to the number of times for calculating the second duty. For example, c is 1 when the calculation is performed once, and 0.1 when the calculation is performed ten times.

$\Delta_k$ are an adjustment values (or changed values) of the second duty with respect to light sources in a predetermined light source group, and is obtained by the following expressions 5 and 6.

$$\Delta_k = C_k \times \left(T_i - \sum_m L_m^i \cdot B_m\right) \quad \text{[Expression 5]}$$

$$C_k = \frac{L_k^i}{\sum_{m \in N_k} (L_m^i)^2} \quad \text{[Expression 6]}$$

The expressions 5 and 6 correspond to the foregoing expression 2, but are different in that the duty calculation of the $k^{th}$ light source is applied to all the light sources in the group including the light source.

Here, $L_k^i$ is an LSC showing a rate of making light travel to a position of the $i^{th}$ block on an image when the $k^{th}$ light source emits light, and has a value between 0 and 1. For example, the LSC of the block closest to the $k^{th}$ light source approximates to 1, but the LSC of the block farthest from the $k^{th}$ light source approximates to 0. Therefore, $\Sigma_m L_m^i \cdot B_m$ is the quantity of light propagated to the $i^{th}$ block on the image on the assumption that all the light sources emit light with the duty value identified with respect to the current light source.

$T_i$ is a target brightness value (i.e. the first target value/the intermediate target value) of the $i^{th}$ block. The first target value is calculated by the foregoing target brightness identifier 121.

Therefore, $\Delta_k$ of the $k^{th}$ light source group in the expression 5 is obtained based on the target brightness (i.e. the first target value/the intermediate target value) of a predetermined block among the image blocks within the screen area ($R_k$) corresponding to the light source (k).

Here, the index i of the corresponding block is calculated by the following expression 7.

$$i = \underset{blk_idx \in R_k}{\operatorname{argmax}} \left\{ T_{blk_idx} - \left( \sum_m L_m^{blk_idx} \cdot B_m \right) \right\}. \quad \text{[Expression 7}$$

By the expression 7, the block index i indicates a block, which the highest value of $T_i - (\Sigma_m L_m^i \cdot B_m)$, among the blocks included in the area ($R_k$) of which the $k_{th}$ light source is in charge, and is identified as the index of the block, of which difference between the target brightness (i.e. the first target value/the intermediate target value) and the quantity of light emitted from the light source to the corresponding block is the greatest, when the BLU 133 is driven with the control value of the current light source. Here, the quantity of light corresponding to the block is the quantity of light propagated to a predetermined block in a case where all the light sources emit light when the BLU 133 is driven with the current control value (i.e. the duty value).

According to the embodiments of the disclosure based on the expressions 4 to 9, the image processor 120 identifies each control value $B'_k$ of the plurality of light source groups (with the light source and its adjacent light sources) based on the control value $B_k$ of the current light source, the largest brightness difference $T_i - (\Sigma_m L_m^i \cdot B_m)$ between the block (i.e. the $i^{th}$ block) and the target brightness when the BLU 133 is driven with the control value of the current light source among the blocks included in the areas of which the plurality of light sources is in charge, and a rate $L_k^i$ by which light travels from each of the plurality of light sources and its adjacent light sources to the block (i.e. the $i^{th}$ block).

In result, the second duty identifier 124 identifies an adjustment value based on the target brightness (i.e. the first target value/the intermediate target value) of a predetermined block (i.e. the $i^{th}$ block), and the rate (LSC) of making light travel to the corresponding block (i.e. the $i^{th}$ block) among the image blocks included in the screen area of the corresponding light source according to light emission of a predetermined light source $B_k$, and calculates the control value (i.e. the second duty) for adjusting the optical output of the light sources in the group, which includes the light source and its adjacent light sources, corresponding to the area $R_k$ including the corresponding block using the identified adjustment value. Here, the second duty identifier 124 calculates the duty value of the light source corresponding to the screen area including the block, based on the calculation results of the block, which has the largest difference between the quantity of light emitted from the light sources in the BLU 133 to the block and the target brightness (the first target value/the intermediate target value), among the blocks included in the area corresponding to a predetermined light source $B_k$.

The second duty identifier 124 iteratively performs calculation of the control value (i.e. the second duty) for each of the plurality of light source groups a predetermined number of times (e.g. ten times) according to the priority, and makes the second duty of a predetermined light source group be continuously updated in consideration of the effect of the current duty value on other light sources, thereby continuously adjusting duty of a dimming control signal applied to each light source.

The foregoing control values i.e. duty values of the light sources, which are finally updated by the first duty identifier 123 and the second duty identifier 123 are output to the BLU driver 134, and the BLU driver 134 drives the BLU 133 to make the light sources emit light in response to the dimming control signal to which the duty values are applied.

The light quantity estimator 125 estimates brightness of each pixel of an input image based on the duty values identified by the first duty identifier 123 and the second duty identifier 123.

Specifically, the light quantity estimator 125 estimates brightness of each pixel on the input image, i.e. emulated backlight luminance, when the BLU 133 is driven by a control signal corresponding to the duty of each light source finally identified by calculation of the first duty identifier 123 and the second duty identifier 123.

The pixel compensator 126 compensates the pixel data of the image signal input based on the brightness value estimated by the light quantity estimator 125.

To this end, the storage 140 is configured to store a table in which compensation data is tabulated matching the estimated brightness value, and the pixel compensator 126 extracts a compensation value from the stored table and compensates the pixel data.

Further, the image of which each pixel data is compensated is displayed on the panel 131.

The display apparatus 100 according to the foregoing embodiment of the disclosure provides an image improved in quality as the duty for controlling the dimming of each light source in the BLU 133 is repetitively updated by the first duty identifier 123 and the second duty identifier 123 in consideration of effects from neighboring light sources, and the brightness of the pixels is further compensated based on the finally updated duty by the light quantity estimator 125 and the pixel compensator 126.

Here, the image processor 120 according to the embodiment of the disclosure shown in FIG. 5 includes the target brightness identifier 121, the priority identifier 122, the first duty identifier 123, the second duty identifier 124, the light quantity estimator 125 and the pixel compensator 126. Alternatively, the elements 121 to 126 in the image processor 120 may be not physical components, but classified according to their functions.

In other words, the image processor 120 according to an embodiment of the disclosure may be actualized by a single chip, and software for operating the chip may implement the functions of the target brightness identifier 121, the priority identifier 122, the first duty identifier 123, the second duty identifier 124, the light quantity estimator 125 and the pixel compensator 126. Further, it will be easily understood by a person having an ordinary skill in the art that the elements of the image processor 120 may be added or deleted according to the performance of the display apparatus 100.

According to an embodiment, the display apparatus 100 may previously receive an image frame and information corresponding to the image frame from an external server, and the image processor 120 may previously perform processes of identifying the target brightness for each image block, the target brightness for each screen area, the priority of the light source corresponding to the area, the duty for each light source according to the priority, and the duty for each light source group according to the priority, based on the received data.

Further, the BLU driver 134 is controlled to perform the dimming based on the previously identified control value i.e. the duty in sync with time when the image of the corresponding frame is received in the panel 131 in accordance with the performed results.

The previously received data and the duty values identified corresponding to an image of a predetermined frame are stored the storage 140.

As described above, the duty values for the light sources/groups are previously identified according to the priority, and the dimming is performed in sync with time when the corresponding frame is displayed as the image. Therefore, a more improved dimming effect is expected.

Figure 7:
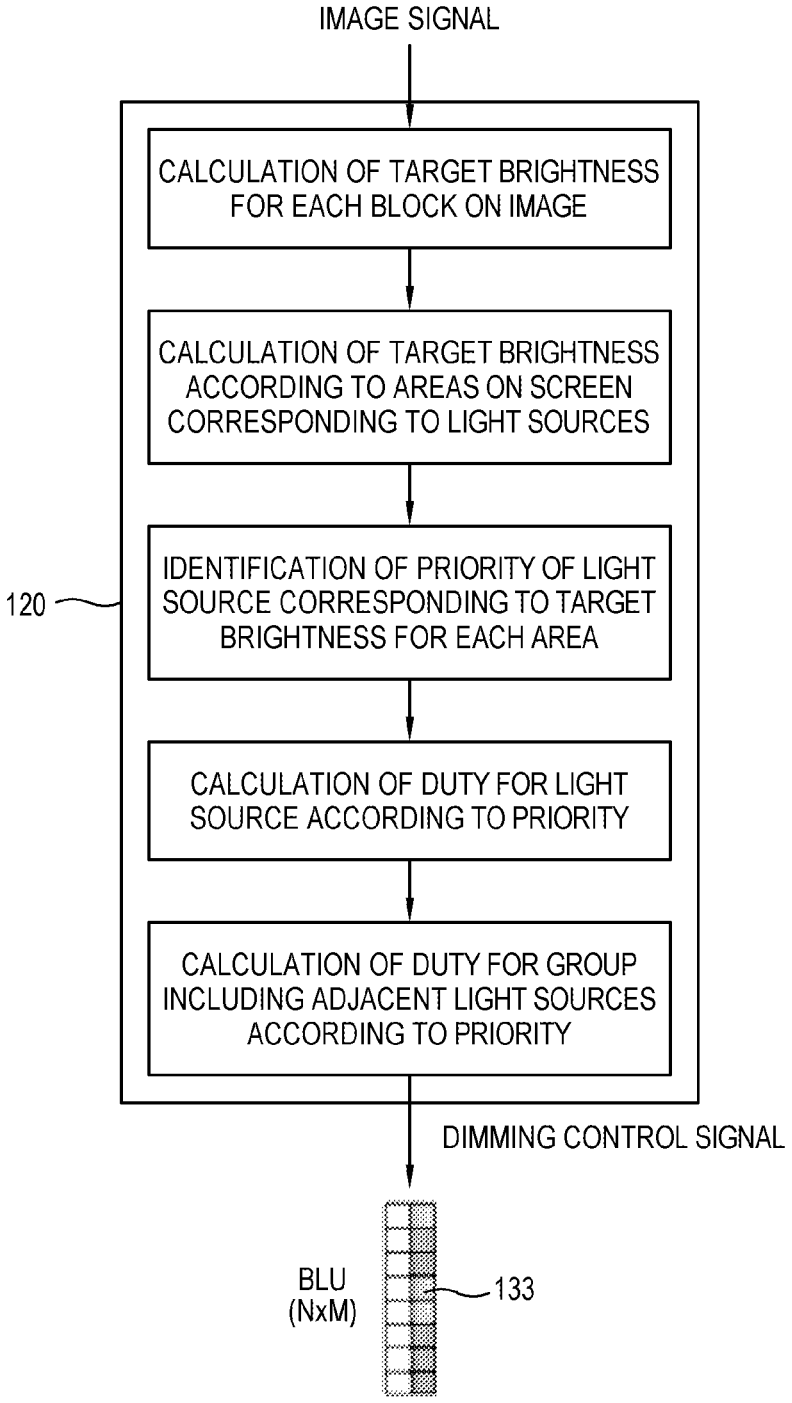
FIGS. 7 and 8 are views for describing an example of generating a dimming control signal for driving light sources in a display apparatus according to an embodiment of the disclosure.
Figure 8:
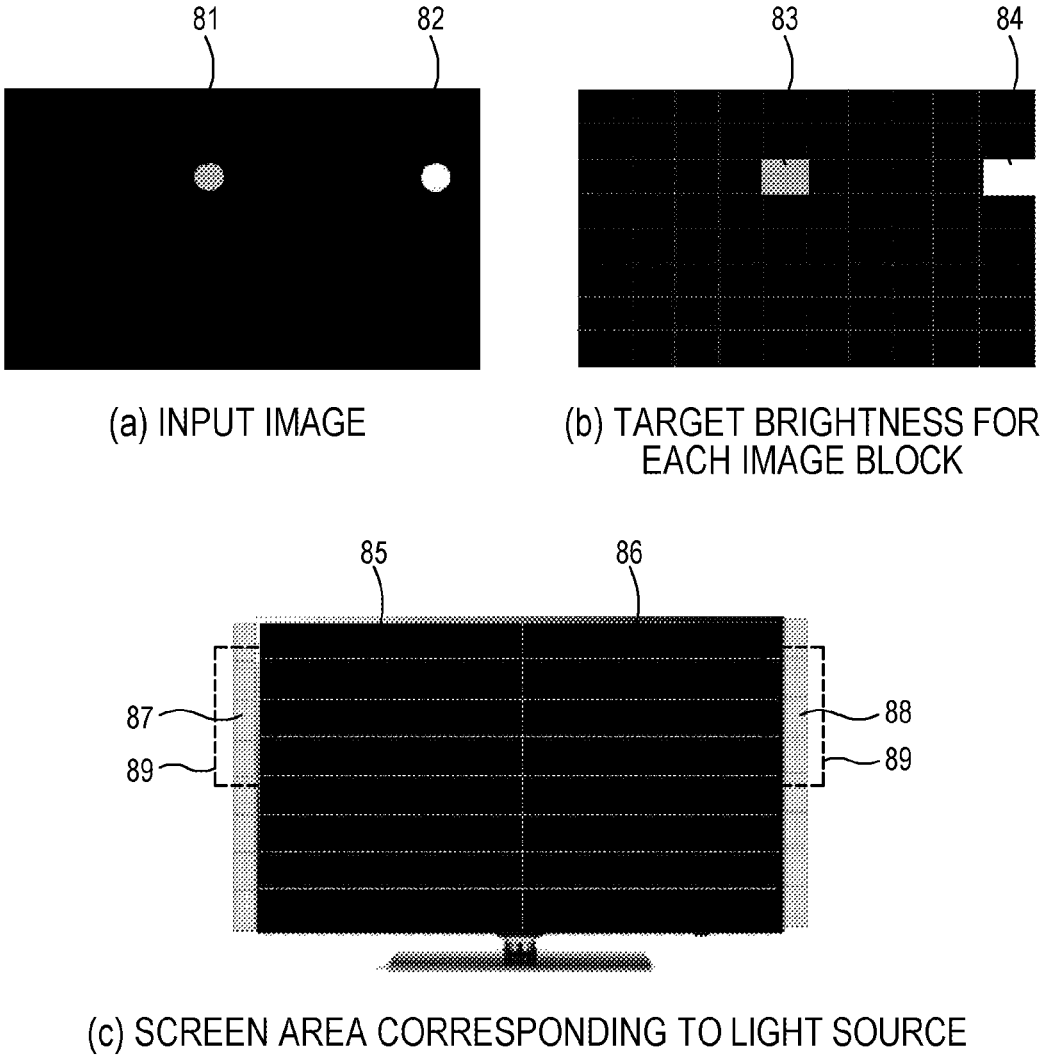

FIGS. 7 and 8 are views for describing an example of generating a dimming control signal for driving light sources of the BLU 133 through an image processing process of the image processor 120 in the display apparatus 100 according to an embodiment of the disclosure.

The image processing process according to an embodiment of the disclosure shown in FIG. 7 is performed in units of image frame.

As shown in FIG. 7, the image processor 120 calculates the target brightness (the first target value/the intermediate target value) according to blocks of an image from an image signal i.e. RGB data. Here, the first target value may be identified based on a weighted sum between the maximum pixel value and the average pixel value in the block.

For example, with regard to an image including two circular icons 81 and 82 different in brightness as shown in (a) of FIG. 8, target brightness i.e. a brightness value is identified as high in image blocks 83 and 84 corresponding to the icons 81 and 82 as shown in (b) of FIG. 8. Here, the block 83 has the highest brightness value.

The image processor 120 calculates the target brightness (a second target value/a final target value) according to the light sources in the BLU 133, which is in charge of the display screen area, using the target brightness according to the image blocks. Here, the second target value may be identified based on a weighted sum between the maximum target brightness value and the average target brightness value of the blocks in the area.

Referring to (c) of FIG. 8, the screen areas 85 and 86 including the blocks 83 and 84 identified as having high brightness in (b) of FIG. 8 have higher target brightness i.e. brightness values than other areas, and the area 86 has the highest target brightness.

The image processor 120 identifies each priority of the light sources corresponding to the screen areas according to such identified target brightness. Here, the higher priority is given to the light source being in charge of the screen area of which the higher brightness value is identified as higher.

For example, the first priority may be given to the light source 88 corresponding to the area 86 having the highest target brightness among the screen areas shown in (c) of FIG. 8, and the second priority may be given to the light source 87 corresponding to the area 85 having the next highest target brightness.

The image processor 120 identifies the control value to adjust the brightness according to the plurality of areas based on the given priority. That is, the image processor 120 adjusts the control value, i.e. the duty to control the optical output with regard to the plurality of light sources corresponding to the plurality of areas. Here, the duty adjustment value for each light source may be calculated based on the foregoing expressions 1 to 3.

For example, referring to (c) of FIG. 8, the duty of the light source 88 is calculated, and then the duty of the light source 87 is calculated. Further, the calculation for the duty of the light source may be iteratively performed once or a predetermined number of times (for example, ten times), and each calculation is performed based on the latest calculated duty values of other light sources.

The image processor 120 updates the control values identified corresponding to the plurality of areas in units of a group including a predetermined area and its adjacent areas according to the previously identified priority. That is, the image processor 120 adjusts the control value i.e. the duty to control the optical output for the light sources in the group including the light source and its adjacent light sources corresponding to the predetermined area and its adjacent areas according to the previously identified priority. Here, the duty adjustment values for the light sources in each group may be calculated based on the foregoing expressions 4 to 7.

For example, as shown in (c) of FIG. 8, the duty is calculated with respect to the light sources (for example, a total of six light sources) present in the group 89 including the light source 88 and a predetermined number of light sources (for example, five light sources) adjacent to the light source 88, and then the duty is calculated with respect to the light sources in the group 89 including the light source 87 and its adjacent light sources. Further, the calculation for the duty of the light source may be iteratively performed once or a predetermined number of times (for example, ten times), and each calculation is performed based on the latest calculated duty values of other light sources.

Further, the dimming control signal for adjusting the optical output based on the finally updated duty values is output to the BLU 133.

Figure 9:
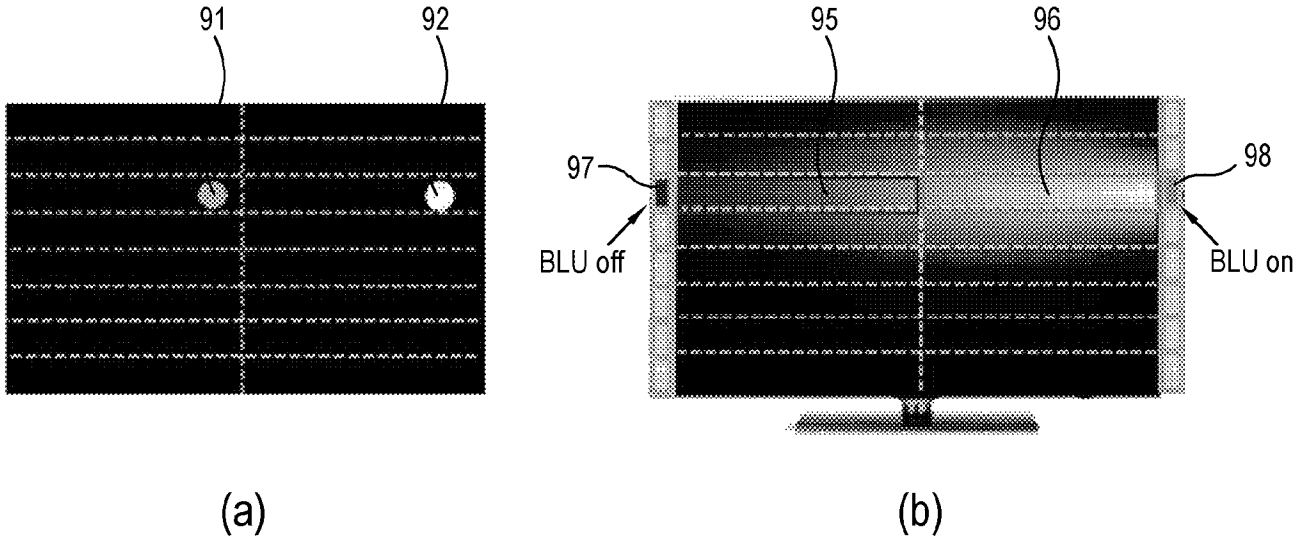
FIG. 9 is a view illustrating an example in which dimming of a light source in a BLU is controlled by light source-based duty-identification and group-based duty-identification according to priority of FIG. 7.
Figure 10:
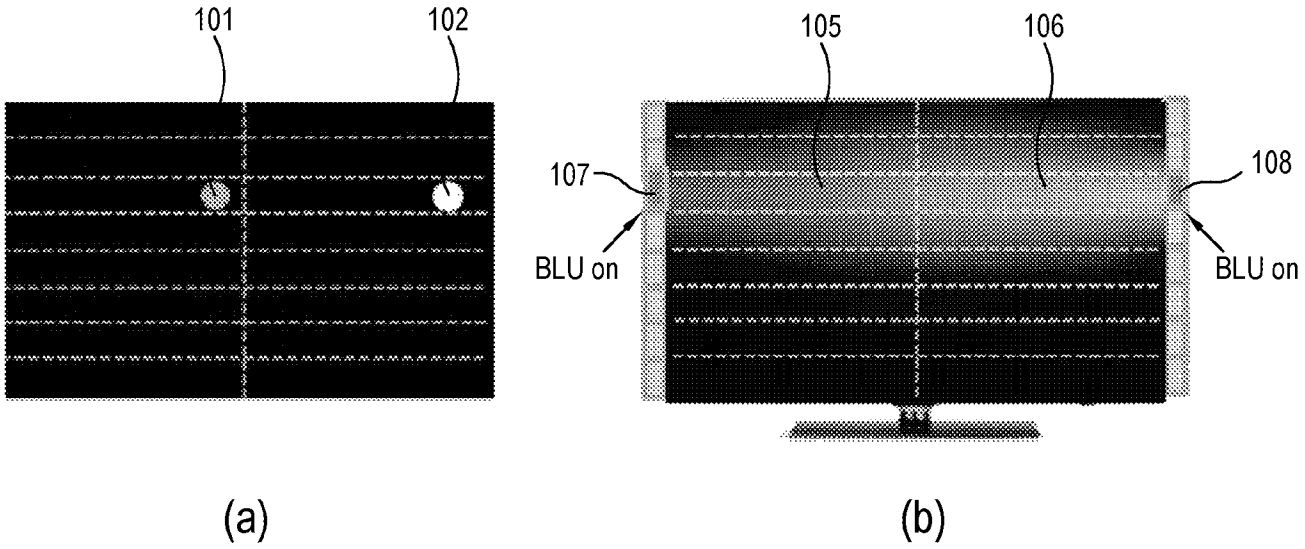
FIG. 10 is a view illustrating an example in which dimming is controlled by a related art that is passive about making use of light interference between light sources.

FIG. 9 is a view illustrating an example in which dimming of a light source in the BLU 133 is controlled by light source-based duty-identification and group-based duty-identification according to priority of FIG. 7, and FIG. 10 is a view illustrating an example in which dimming is controlled by a related art that is passive about making use of light interference between light sources.

As shown in FIG. 9, when the duty for each area/light source is identified according to the priority based on the brightness of the image according to an embodiment of the disclosure, and the duty is updated for each group including the areas/light sources, light from a light source 98, to which the highest priority is given corresponding to an area 96 on which displaying the brightest image 92 is displayed, is emitted to an adjacent area 95.

Thus, although a light source 97 corresponding to an area 95, to which the next highest priority is given under the dimming control, is turned off, light enough to illuminating the area 95 is supplied. In addition, power consumption is reduced as the light source 97 is turned off.

On the other hand, under the conventional dimming control shown in FIG. 10, both light sources 107 and 108 are all turned on corresponding to the areas 105 and 106 on which bright images 101 and 102 are displayed, and therefore more light diffusion is caused as shown in (b) of FIG. 10 due to light emission of the BLU 133 as compared with that of (b) of FIG. 9.

Figure 11:
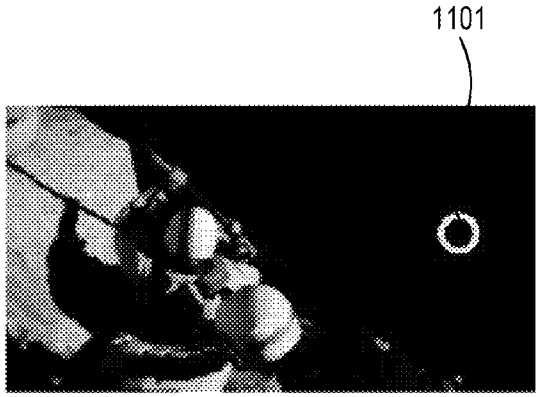
FIG. 11 illustrates an example in which light leakage is decreased in a display apparatus according to an embodiment of the disclosure.
Figure 11:
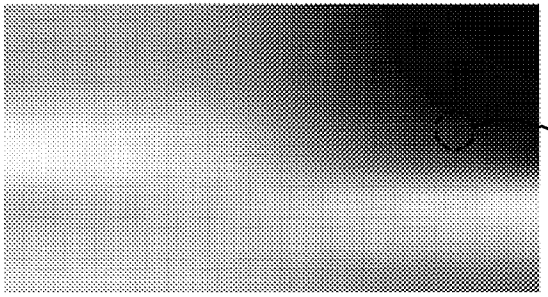

FIG. 11 illustrates an example in which light leakage is decreased in the display apparatus 100 according to an embodiment of the disclosure.

When update for each individual area/light source according to the foregoing priority and duty update for each individual area/light source group are sequentially performed with regard to an image including black data 1001 as shown in (a) of FIG. 11, the light leakage is more decreased in a portion 1102 corresponding to the black data as shown in (d) of FIG. 11 than that in a conventional black data portion 1102 as shown in (c) of FIG. 11.

As shown in (b) of FIG. 11, when the black data level of the image is measured, its value (the lowest brightness) is lowered, and it will be thus understood that the brightness of the black data is more decreased. Therefore, it is expected that a contrast ratio is improved.

Further, (b) of FIG. 11 shows that power consumption is also reduced.

Figure 12:
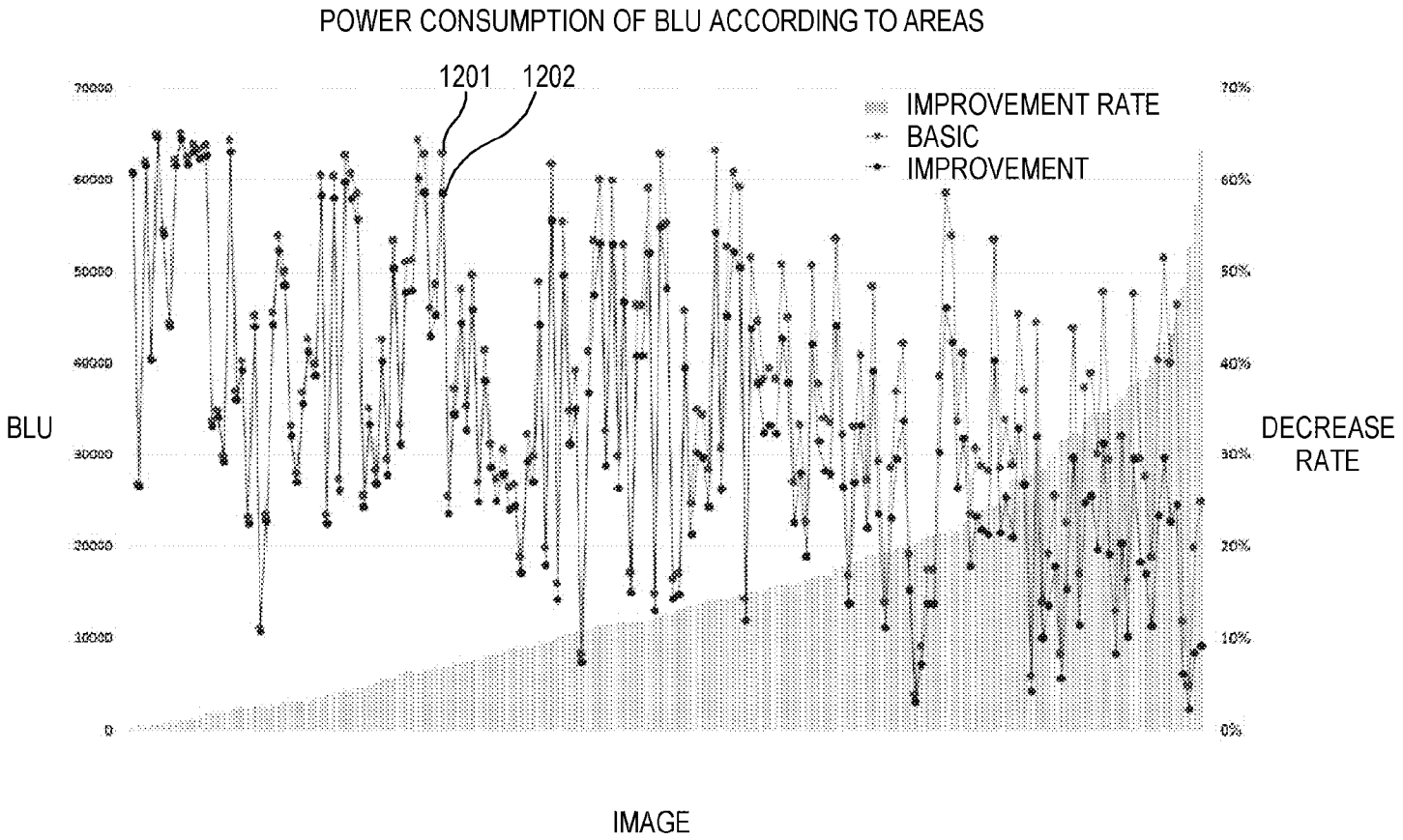
FIG. 12 is a graph showing an effect on reducing power consumption in a BLU according an embodiment of the disclosure.

FIG. 12 is a graph showing an effect on reducing power consumption in the BLU 133 according an embodiment of the disclosure.

As shown in FIG. 12, power consumption 1201 in the BLU 133 subjected to update for each individual area/light source according to the priority and duty update for each individual area/light source group according to an embodiment of the disclosure is more reduced by about 15% than power consumption 1201 in the conventional BLU.

Below, a method of controlling a display apparatus according to an embodiment of the disclosure will be described with reference to the accompanying drawing.

Figure 13:
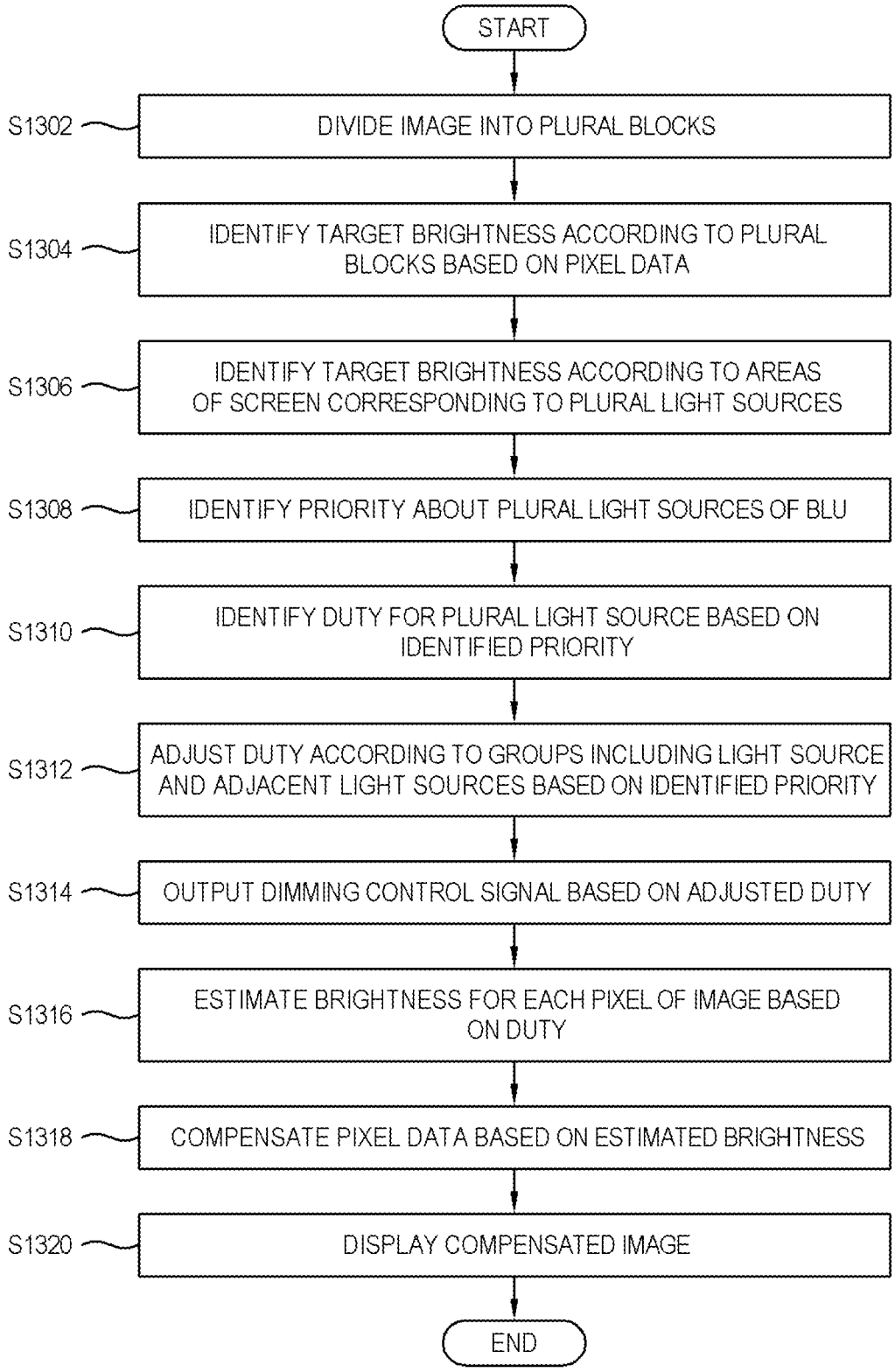
FIG. 13 is a flowchart showing a control method of a display apparatus according an embodiment of the disclosure.

FIG. 13 is a flowchart showing a control method of a display apparatus 100 according an embodiment of the disclosure.

As shown in FIG. 13, the image processor 120 in the display apparatus 100 according to an embodiment of the disclosure may divide an input image of a frame unit into a plurality of, i.e. H by W virtual blocks (S1302). Here, the number of blocks may be varied depending on the size of the image, and may for example be 16×8 blocks.

The image processor 120 identifies the target brightness i.e. the first target value/the intermediate target value according to blocks divided in the operation S1302 based on an input image signal (S1304). The target brightness for each block is calculated based on the pixel data of the pixels included in the corresponding block, and for example, based on a weighted sum between the maximum pixel value in the block and the average pixel value.

The image processor 120 may identify the target brightness i.e. the second target value according to a plurality of, i.e. N by M screen areas corresponding to the plurality of light sources based on the target brightness for each area in the operation S1304 (S1306). The plurality of areas may be set corresponding to individual units, i.e. the light sources in the BLU 133, for example, 2×8 areas. Therefore, the plurality of areas includes the plurality of blocks (e.g. blocks divided in the operation S1302) arrayed along a traveling direction of light output from the corresponding light source. The target brightness for an area may be calculated based on the first target values of the blocks included in the corresponding area, and may for example be calculated based on a weighted sum between the maximum brightness value in the area and the average brightness.

Further, the image processor 120 identifies the priority about the plurality of light sources in the BLU 133, which are in charge of the plurality of areas, to match the second target value/final target value according to the areas identified in the operation S1306 (S1308). Therefore, the priority of the corresponding light source is identified in high order of the target brightness of the area.

The image processor 120 identifies the control value, i.e. the duty according to the plurality of light sources so that the plurality of areas can be adjusted in brightness according to the priority identified in the operation S1308 (S1310). By the identified control value, the optical output from each of the plurality of light sources is controlled. The image processor 120 may adjust the control value, which will be applied to each of the plurality of light sources, based on the control value of the current light source, difference in the brightness of the block having the largest difference from the target brightness when the BLU 133 is driven with the control value of the current light source, among the blocks included in the area of which each of the plurality of light sources is in charge, and a rate of making light from each of the plurality of light sources travel to the block.

The identification of the duty in the operation S1310 may be performed once or iteratively performed two or more times according to the priority identified in the operation S1308.

The image processor 120 adjusts, i.e. updates the duty according to the light source groups (in units of the group) including a predetermined light source and light sources adjacent to the light source according to the priority identified in the operation S1308 (S1312). The image processor 120 may adjust the control value to be applied to the group including each of the plurality of light sources and its adjacent light sources, based on the control value of the current light source, difference in the brightness of the block having the largest difference from the target brightness when the BLU 133 is driven with the control value of the current light source, among the blocks included in the area of which each of the plurality of light sources is in charge, and a rate of making light from each of the plurality of light sources travel to the block. The group-based duty-identification in the operation S1312 may be performed once or iteratively performed two or more times according to the priority identified in the operation S1308.

Further, the dimming control signal is output to the BLU 133 to match the duty finally adjusted through the operation S1310 and S1312 (S1314).

Meanwhile, the image processor 120 may estimate the brightness according to pixels on the image based on the duty adjusted through the operations S1310 and S1312 (S1316).

The image processor 120 compensates the pixel data of the image based on the brightness of the pixels estimated in the operation S1316 (S1318). Here, the storage 150 is configured to store a table where compensation data is tabulated matching the estimated brightness, and the image processor 120 may read a compensation value from the table and compensate each piece of the pixel data.

Further, the image with the pixel data compensated in the operation S1318 is displayed on the panel 131 (S1320).

According to various embodiments of the disclosure as described above, the target value about the brightness for each screen area is identified based on the pixel data of the image, and the duty is identified as the control value to control the brightness of the area in high order of the target value. The optical outputs of the light sources in the BLU are adjusted according to the identified duty, thereby controlling the brightness of the screen area. Therefore, the duty of the brightest area with the highest priority is first adjusted, and then the duty of the area with the next highest priority is adjusted based on the duty of the brightest area.

Therefore, the display apparatus according to an embodiment of the disclosure generates the dimming control signal by considering effects of light diffusion from the light source of the adjacent neighboring area to perform the local dimming for improving the contrast of the screen, thereby having an effect on decreasing light leakage. Further, the duty for decreasing the light diffusion is not increased more than needed, thereby reducing power consumption in the BLU.

In the display apparatus according to another embodiment of the disclosure, the area/light source-based duty-identification according to the priority and the group-based duty-identification including even the adjacent area/light source are performed in sequence to adjust the duty, and the area/light source-based duty-identification and the group-based duty-identification may be iteratively performed a predetermined number of times according to the priority. Therefore, the dimming is effectively achieved while very efficiently avoiding effects of the light diffusion from the neighboring light sources.

Further, in the display apparatus according to still another embodiment of the disclosure, the brightness of the area is estimated based on the adjusted duty to thereby compensate the pixel data of the image, thereby providing an image of more improved quality to a user.

The foregoing display apparatus according to an embodiment of the disclosure is an edge-type LCD apparatus, and more improved effects are expected when the number of light sources in the BLU is smaller than the resolution of the display.

Meanwhile, the foregoing various embodiments of the disclosure may be realized by a computer readable recording medium. The computer readable recording medium includes a transmission medium and a storage medium configured to store data readable by a computer system. The transmission medium may be actualized by a wired/wireless network through which computer systems are linked to one another.

The foregoing various embodiments may be realized by hardware and combination between hardware and software. As the hardware, the controller 150 may include a nonvolatile memory in which a computer program is stored as the software, a RAM in which the computer program stored in the nonvolatile memory is loaded, and a CPU configured to execute the computer program loaded in the RAM. The nonvolatile memory may include a hard disk drive, a flash memory, a ROM, CD-ROMs, magnetic tapes, a floppy disc, an optical storage, a data transmission device using the Internet, etc., but is not limited thereto. The nonvolatile memory is a kind of computer-readable recording medium in which the program readable by a computer of the disclosure is recorded.

The computer program refers to a code that is read and executed by a processor including the CPU and an IC, and includes codes for performing the operation of the controller 150 and/or the image processor 120, such as the operation S2302 to S1320 as shown in FIG. 13.

The computer program may be actualized as included in an operating system provided in the display apparatus 100, or software including an application, and/or software interfacing with an external apparatus.

Although the disclosure has been shown and described through exemplary embodiments, the disclosure is not limited to the exemplary embodiments and may be variously actualized within the appended claims.

The invention claimed is:

1. A display apparatus comprising:

a display configured to display an image;

a backlight unit (BLU) comprising a plurality of light sources configured to emit light to a screen of the display;

an image processor configured to:

divide an input image into a plurality of blocks, identify a target brightness for each block based on brightness of the input image corresponding to each block, identify priority of the plurality of light sources corresponding to the plurality of blocks in an order of the target brightness, and adjust a control value of each of the plurality of light sources based on the identified target brightness for each block, wherein the control value of a first light source having a higher priority is adjusted prior to a second light source having a lower priority; and a driver configured to drive the plurality of light sources based on the adjusted control values, wherein the images processor is further configured to:

adjust the control value for each of the plurality of light sources based on the priority, and then adjust the control value for each of the plurality of light sources and light sources adjacent thereto based on the priority, and adjust the control value for each of the plurality of light sources, based on a control value of a current light source, a brightness difference value of a block, which has a largest difference from the target brightness with the BLU being driven by the control value of the current light source, among blocks included in an area of which each of the plurality of light sources is in charge, and a rate of making light travel from each of the plurality of light sources to the block.

2. The display apparatus according to claim 1, wherein the priority of each of the plurality of light sources is varied depending on a target brightness value of the block included in the area of which each of the plurality of light sources is in charge.

3. The display apparatus according to claim 1, wherein the image processor adjusts the control values for each of the plurality of light sources and light sources adjacent thereto, based on the control value of the current light source, the brightness difference value of the block, which has the largest difference from the target brightness with the BLU being driven by the control value of the current light source, among the blocks included in the area of which each of the plurality of light sources is in charge, and the rate of making the light travel from each of the plurality of light sources and light sources adjacent thereto to the block.

4. The display apparatus according to claim 1, wherein the control value for each of the plurality of light sources is adjusted once or iteratively a predetermined number of times.

5. The display apparatus according to claim 1, wherein the control values for each of the plurality of light sources and light sources adjacent thereto are adjusted once or iteratively a predetermined number of times.

6. The display apparatus according to claim 1, wherein the target brightness is identified based on a weighted sum of a maximum pixel value and an average pixel value in the block.

7. The display apparatus according to claim 1, wherein the image processor estimates brightness according to pixels of the input image based on the adjusted control values, and compensates pixel data of the input image based on the estimated brightness.

8. A method of controlling a display apparatus, the method comprising:

dividing an input image into a plurality of blocks;

identifying a target brightness for each block based on brightness of the input image corresponding to each block;

identify priority of a plurality of light sources that constitute a backlight unit (BLU), corresponding to the plurality of blocks in an order of the target brightness;

adjusting a control value of each of the plurality of light sources based on the identified target brightness for each block, wherein the control value of a first light source having a higher priority is adjusted prior to a second light source having a lower priority; and driving the plurality of light sources to emit light to a display screen based on the adjusted control values, wherein the adjusting the control value of each of the plurality of light sources further comprises:

adjusting the control value for each of the plurality of light sources based on the priority, and then adjust the control value for each of the plurality of light sources and light sources adjacent thereto based on the priority, and adjusting the control value for each of the plurality of light sources, based on a control value of a current light source, a brightness difference value of a block, which has a largest difference from the target brightness with the BLU being driven by the control value of the current light source, among blocks included in an area of which each of the plurality of light sources is in charge, and a rate of making light travel from each of the plurality of light sources to the block.

9. The method according to claim 8, wherein the priority of each of the plurality of light sources is varied depending on a target brightness value of the block included in the area of which each of the plurality of light sources is in charge.

10. The method according to claim 8, wherein the adjusting the control value for each of the plurality of light sources and light sources adjacent thereto further comprises adjusting control values for each of the plurality of light sources and light sources adjacent thereto, based on the control value of the current light source, the brightness difference value of the block, which has the largest difference from the target brightness with the BLU being driven by the control value of the current light source, among the blocks included in the area of which each of the plurality of light sources is in charge, and the rate of making the light travel from each of the plurality of light sources and light sources adjacent thereto to the block.

11. The method according to claim 8, wherein the target brightness is identified based on a weighted sum of a maximum pixel value and an average pixel value in the block, and the method further comprising:

estimating brightness according to pixels of the input image based on the adjusted control values; and compensating pixel data of the input image based on the estimated brightness.

* * * * *